US006918163B2

(12) United States Patent
Pace et al.

(10) Patent No.: US 6,918,163 B2
(45) Date of Patent: Jul. 19, 2005

(54) SHRINK-WRAP CASKET SHIELD

(76) Inventors: Jonathan Pace, 52 Hoagland Dr., Belle Meade, NJ (US) 08502; Edward Wilson, 7 Vahlsing Way, Robbinsville, NJ (US) 08691

( * ) Notice: Subject to any disclaimer, the term of this patent is extended or adjusted under 35 U.S.C. 154(b) by 865 days.

(21) Appl. No.: 09/737,402

(22) Filed: Dec. 15, 2000

(65) Prior Publication Data

US 2004/0031133 A1 Feb. 19, 2004

Related U.S. Application Data

(60) Provisional application No. 60/171,141, filed on Dec. 16, 1999.

(51) Int. Cl.[7] ..... A61G 17/00
(52) U.S. Cl. ..... 27/19; 27/35
(58) Field of Search ..... 27/2, 11, 19, 35; 52/131–134

(56) References Cited

U.S. PATENT DOCUMENTS 4,537,119 A * 8/1985 Jarnot ..... 454/275
4,727,632 A * 3/1988 Yearsley ..... 27/35
4,922,590 A * 5/1990 Yearsley ..... 27/19
6,016,828 A * 1/2000 Machledt ..... 137/202
6,253,503 B1 * 7/2001 Flood ..... 52/134
6,510,596 B1 * 1/2003 McCarthy ..... 27/1

OTHER PUBLICATIONS

Forbes.Com, "No Grave Undertaking".*

HoustonChronicle.com, "New in funerals: wrapped caskets", Jun. 1998.*

* cited by examiner

*Primary Examiner*—William L. Miller
(74) *Attorney, Agent, or Firm*—Reed Smith LLP

(57) ABSTRACT

The invention is directed to shrink wrapping a casket to be entombed, including an article of a shrink wrapped casket with a ventilation port including a filter and a method comprising steps of sealing the wrap with shrink wrap tape and providing two-way ventilation by placing a ventilation filter that is impenetrable to the phorid fly. This invention overcomes problems associated with the entombment of caskets in aboveground mausoleum crypts, such as fluids escaping from the casket and phorid fly infestations.

4 Claims, 4 Drawing Sheets

SHRINK-WRAP CASKET SHIELD

CROSS-REFERENCE TO RELATED APPLICATIONS

The present application claims priority to Provisional Application 60/171,141 filed on Dec. 16, 1999.

FIELD OF INVENTION

This invention relates to the art of mortuary science, and in particular, to a shield to protect the Mausoleum crypt chamber, adjacent chambers, crypt fronts, the building on the whole and any persons visiting the building.

BACKGROUND OF INVENTION

In mortuary science, there is a need for a ventilated enclosure which is impenetrable to insects such as crypt gnats (Phorid flies) and that will contain and help evaporate any fluids that may escape from the casket.

SUMMARY OF INVENTION

This invention encompasses a casket, enclosed by a shrink-wrap shield fitted with a ventilation port which allows for the passage of gases but not for the passage of crypt gnats. This invention encompasses a method of creating a ventilated enclosure which is impenetrable to insects such as crypt gnats. This invention encompasses a method of shrink-wrapping a casket with plastic suitable for shrink wrapping, comprising steps of wrapping the casket with said plastic, sealing all seams to prevent fluid seepage, applying heat to seal the plastic about the casket, and inserting a ventilation port comprising a special screen material which is completely impenetrable to crypt gnats but which allows flow of substances in the gas phase

BRIEF DESCRIPTION OF THE DRAWING

The present invention and its presently preferred embodiments will be better understood by way of reference to the detailed disclosure hereinbelow and to the accompanying drawings, wherein.

DETAILED DESCRIPTION OF INVENTION

This invention overcomes problems associated with the entombment of caskets in aboveground mausoleum crypts. This invention provides protection for the Mausoleum crypt chamber, adjacent chambers, crypt fronts, the building on the whole and any persons visiting the building from contact with any fluids that may escape from caskets due to decomposition of material within the casket. This Mausoleum crypt protector also protects from any phorid fly infestations. This is accomplished by shrink wrapping the casket to be entombed with a plastic, then sealing the wrapped plastic with shrink wrap tape and providing two way ventilation by placing a ventilation filter that is impenetrable to the phorid fly. This allows for evaporation of any liquid that may seep from the casket. This wrapping takes place on a tray that is then used to transport the wrapped casket into a crypt without damaging the wrap. This wrap may be transparent, which transparency aids in casket identification.

Figure 1:
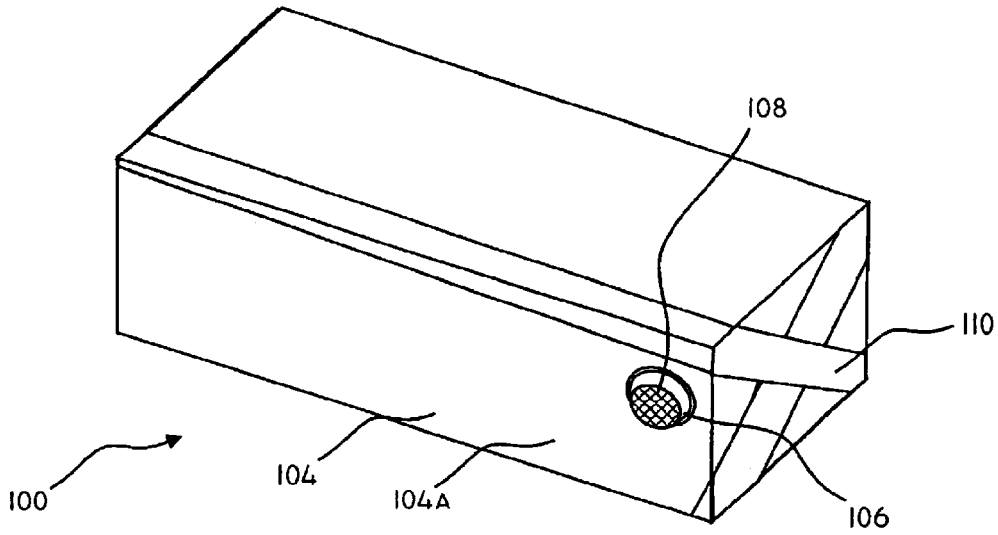
FIG. 1 illustrates a casket shield according to the present invention.

As shown in FIG. 1, a shrink-wrap casket shield 100 is provided for enclosing caskets 102 (not visible within shield) within a barrier that is impenetrable to crypt gnats (Phorid Flies). The invention involves enclosing a casket 102 within a shrink-wrap plastic enclosure 101 that is sealed except for a ventilation port 106 that permits air to flow into and out of the enclosure 104 through a screen 108 that is impenetrable to crypt gnats.

The shrink-wrap casket shield 100 differs from U.S. Pat. No. 4,922,590 ("Yearsley") in that the casket 102 is not hermetically sealed within the shrink-wrap casket shield 100. Yearsley is directed to hermetically sealing the casket within an enclosure. In contrast, the present invention is based on the theory that a practical casket enclosure system preferably allows air to be able to continuously flow in either direction into and out of the casket enclosure with the proviso that means are provided for adequately assuring that the casket shield is impenetrable to crypt gnats.

For this purpose, as an illustrative embodiment of the invention, the casket may be wrapped in a sheet of plastic 104*a* such as used for shrink wrapping boats for winter storage. Such plastic sheets are commercially available, for example, as Shrink-Wrap from Buffalo Shrink-Wrap, East Amherst, N.Y., 14051, specifically 5–7 mil, clear shrink-wrap, having part number 720298C. After wrapping the casket within the plastic sheet 104*a*, the sheets may be completely sealed and shrink wrapped using known methods for shrink wrapping large objects in plastic sheets, for example, with application of a heat gun.

Optionally, all seams are sealed with tape 110 made for sealing seams which is commercially available. An example is tape available from Buffalo Shrink-Wrap, East Amherst, N.Y. 14051, which is in 4" or 6" widths, having part number BSW6180C.

A ventilation port 106 is provided in the shield 100 that permits two-way flow of air into and out of the enclosure, for example, using a ventilator such as described in U.S. Pat. No. 4,537,119, wherein the ventilator includes a special screen material that is completely impenetrable to crypt gnats but penetrable to air flow in either direction. The ventilation port 106 may be obtained from Airlette Manufacturing Corporation of Lantana, Fla., and the screen material that is impenetrable to crypt gnats (and is corrosion resistant under the contemplated use) is commercially available, for example, as Monofilament Screening from Synthetic Industries, Performance Fabric Division, Gainesville, Ga. 30503, specifically as Style #69515000, having a warp of 52×52 threads/inch according to ASTM D3775. The opening size for this fabric is 285 microns. The open area of this fabric is 34%. The invention works for a fabric of opening size less than 285 microns, such that there is a two-way flow of air through the fabric. One may use an opening size 250 microns. In a different embodiment, one could use a corrosion-resistant mesh of size −325 mesh.

Figure 2A:
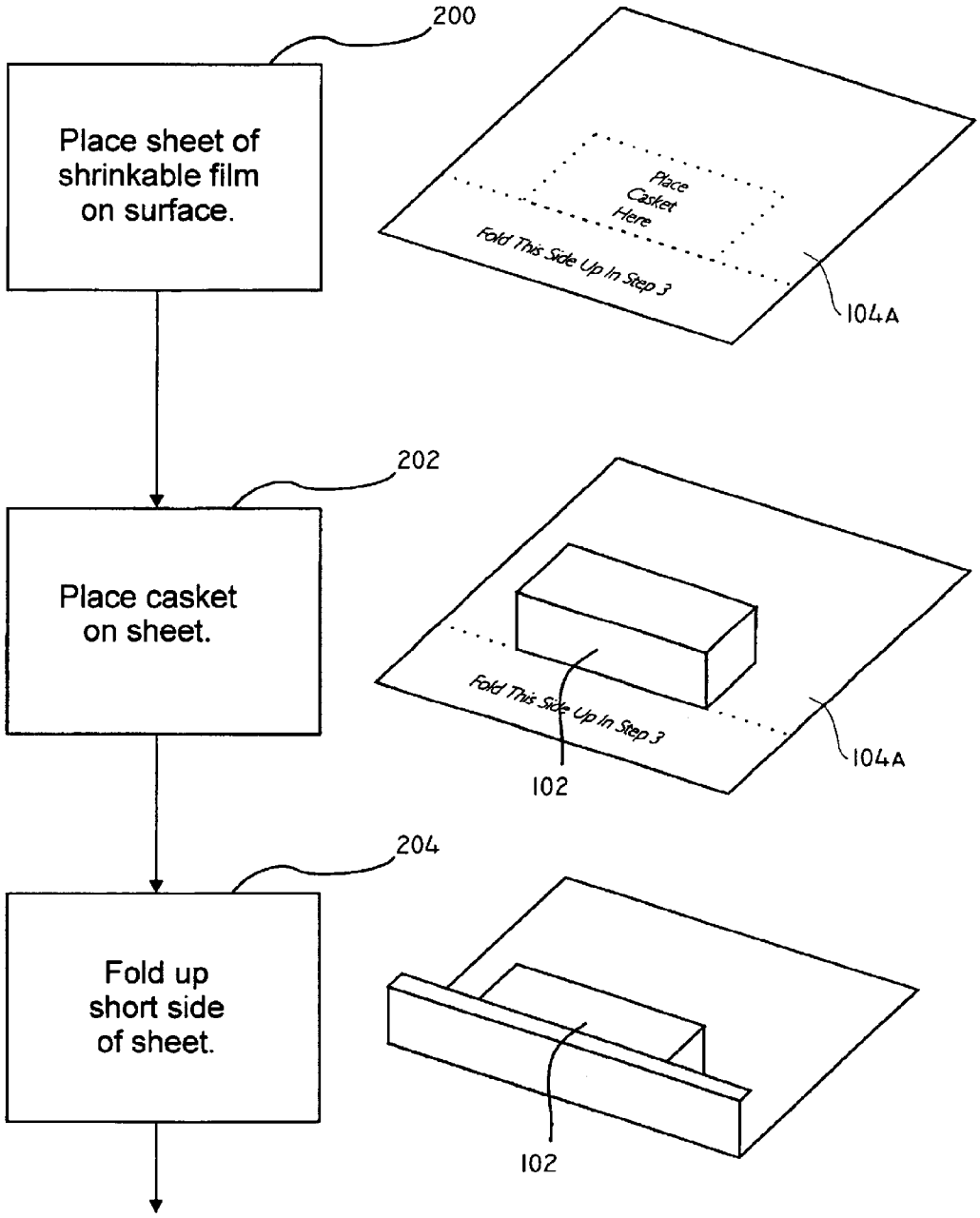
FIG. 2 Diagram giving suggested method of wrapping the casket
Figure 2B:
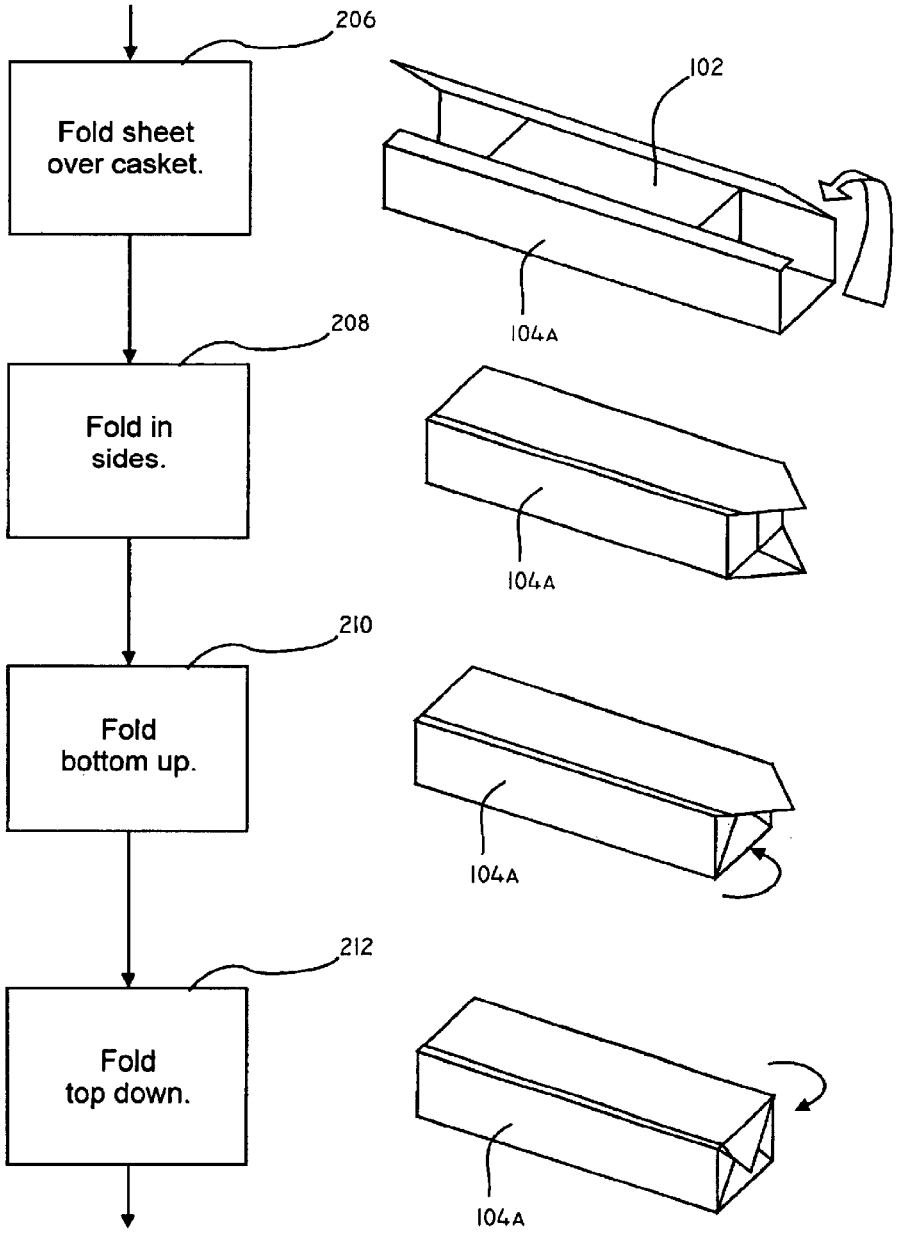
Figure 2C:
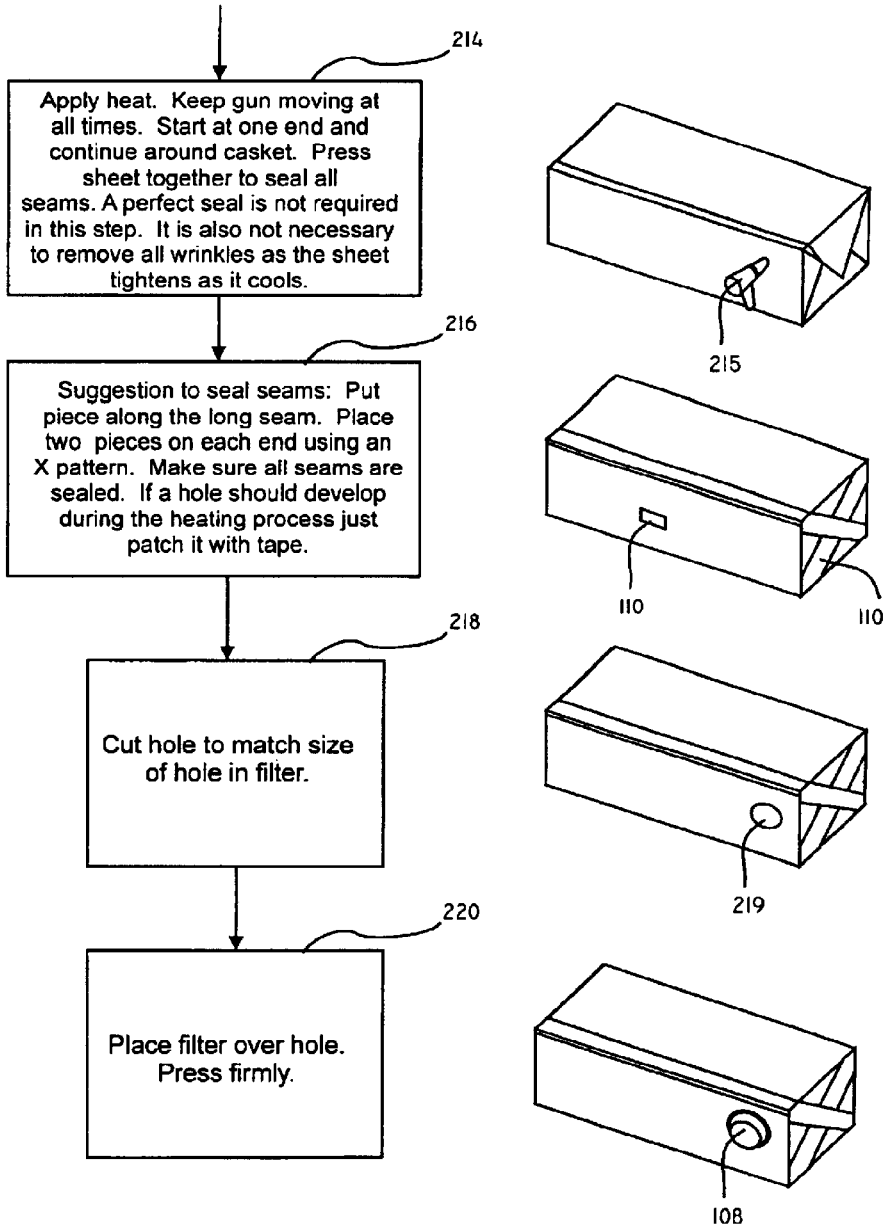

The components that are required for the shrink-wrap casket shield may be readily obtained from known sources and conveniently packaged in a kit for distribution and shipping to the desired location for convenient on-site assembling of the components. The kit may comprise, for example, a plastic sheet clearly marked with lines showing where the casket is to be placed and with simple, easy-to-follow instructions for enclosing the casket within the shrink-wrap shield., and a transparent or colored plastic sheet of a size that will wrap any casket that will fit in a typical modern Mausoleum Crypt and be clearly marked. An embodiment of a method comprises the following steps, as shown in FIG. 2:

Place Casket This Side

Place 202 sheet 104*a* in tray lining up line with edge of tray. (Diagram)

Place 204 casket 102 on sheet 104*a*. Attach identification tag to casket.

Fold 204, 206 sheet 104*a* over casket and trim off excess to the bottom of the tray. (Diagram)

Make side folds 208, 210, 212. (Diagram)

Apply 214 heat with heat gun 215. Start at one end and continue down the length finishing at other end. (Keep heat moving at all times) (Press seams with gloved hand to ensure good seal)

Apply 216 heat shrink tape 110 to all seams. Heat tape being careful to avoid overheating.

Form 218 hole 219 for port.

Place 220 screen on ventilator over hole, adhering on joining screen on ventilator to sheet 104*a*.

In summary, the shrink-wrap casket shield as disclosed herein provides the following benefits and advantages:

an impenetrable barrier against crypt gnats;

protection against liquid leakage;

protection for wood caskets;

a two-way ventilation system;

a safe, simple and quick process requiring only a few minutes to install;

low cost;

transparent sealing material for easy casket identification, e.g., for temporary entombments;

Kit application for convenient shipping and assembling of the components; and use of simple, readily available materials.

What is claimed is:

1. A casket within a shrink-wrap plastic enclosure, the enclosure being sealed except for a ventilation port formed therethrough that permits air to flow into and out of the enclosure, said ventilation port being covered by a screen that is impenetrable to crypt gnats.

2. The casket of claim 1 wherein the screen has an opening size of less than or equal to 285 microns.

3. The casket of claim 1 wherein the screen comprises a polymeric fabric.

4. A method for making a casket with a shrink wrap plastic enclosure comprising steps of:

placing casket on a sheet of shrink wrap plastic and folding the shrink wrap plastic about the casket to enclose the casket therein;

sealing all seams of the shrink wrap plastic enclosure with tape;

applying heat to heat shrink the plastic; and forming a ventilation port in the enclosure that permits air to flow into and out of the enclosure, said ventilation port being covered by a screen that is impenetrable to crypt gnats.

* * * * *